US010737871B2

(12) United States Patent
Shalowitz

(10) Patent No.: US 10,737,871 B2
(45) Date of Patent: Aug. 11, 2020

(54) FOOD CONTAINER AND DISPENSER

(71) Applicant: Joel Shalowitz, Baltimore, MD (US)

(72) Inventor: Joel Shalowitz, Baltimore, MD (US)

( * ) Notice: Subject to any disclaimer, the term of this patent is extended or adjusted under 35 U.S.C. 154(b) by 0 days.

(21) Appl. No.: 16/395,523

(22) Filed: Apr. 26, 2019

(65) Prior Publication Data

US 2019/0329963 A1 Oct. 31, 2019

Related U.S. Application Data

(60) Provisional application No. 62/663,336, filed on Apr. 27, 2018.

(51) Int. Cl.
*B65D 83/00* (2006.01)

(52) U.S. Cl.
CPC ..... *B65D 83/0072* (2013.01)

(58) Field of Classification Search
CPC ..... B65D 83/0005; B65D 83/005; B65D 83/0055; B65D 83/0072; B65D 83/0061; B65D 83/62; B65D 83/00; B65D 83/0022; B65D 83/0027; B65D 83/0033; B65D 83/0044; B65D 25/04; B65D 43/02; B65D 85/00; B65D 85/80; B65D 81/3255; B65D 81/3211; B65D 35/30; B65D 83/0823; B65D 83/0835; B65D 83/0864; B65D 83/0436; A47G 19/32; A47G 19/34; B65H 1/08; B05C 17/00576; A45D 2200/055; A45D 34/04; B65B 3/045; A47F 1/06
See application file for complete search history.

(56) References Cited

U.S. PATENT DOCUMENTS 1,933,596 A * 11/1933 Showles ..... A23G 9/503 426/115
3,349,965 A * 10/1967 Krugger ..... B65D 77/067 222/80
3,442,424 A * 5/1969 Prussin ..... B65D 35/22 222/81
4,020,978 A * 5/1977 Szczepanski ..... B05B 11/046 222/209
4,562,942 A 1/1986 Diamond
4,842,165 A 6/1989 Van Coney
(Continued)

FOREIGN PATENT DOCUMENTS

CN 206798087 12/2017
DE 3202275 8/1983
(Continued)

*Primary Examiner* — Ericson M Lachica
(74) *Attorney, Agent, or Firm* — Whiteford, Taylor & Preston, LLP; Gregory M. Stone

(57) ABSTRACT

A portable food carrier is disclosed, including a flexible, compressible outer container body and an internal lift having a tapered bottom. The tapered bottom of the lift is particularly configured to allow a user to grasp the carrier and squeeze the container body at the location of the taper, causing the lift to move upward in the container, in turn pushing food product located above the lift toward an open, top mouth of the container, where the user may then access and eat the food product. The lift is configured to interact with the interior of the container in such a way so as to assist the user in maintaining smooth movement as the user squeezes the outside of the container, thus making it optimized for use with only one hand.

23 Claims, 11 Drawing Sheets

(56) References Cited

U.S. PATENT DOCUMENTS

| | | | | |
|---|---|---|---|---|
| 5,699,920 | A | 12/1997 | Ida et al. | |
| 5,747,083 | A | 5/1998 | Raymond et al. | |
| 5,799,808 | A | 9/1998 | Oh | |
| 7,467,731 | B2 | 12/2008 | Shraiber | |
| 7,967,169 | B2 | 6/2011 | Hanan | |
| 8,235,257 | B2 | 8/2012 | Avairis | |
| 8,523,013 | B2 | 9/2013 | Sines | |
| 8,529,974 | B2 | 9/2013 | Ortiz et al. | |
| 2006/0054635 | A1* | 3/2006 | Iwahashi | A61F 9/0008 222/107 |
| 2006/0065132 | A1* | 3/2006 | Jongen | B65D 83/0055 99/485 |
| 2006/0201963 | A1* | 9/2006 | Sines | B65D 21/08 221/279 |
| 2006/0249534 | A1* | 11/2006 | Sainz | B65D 83/04 222/92 |
| 2007/0062977 | A1* | 3/2007 | Ferrarin | B65D 35/30 222/386 |
| 2008/0302826 | A1* | 12/2008 | Rich, Jr. | B65D 35/30 222/158 |
| 2009/0014473 | A1* | 1/2009 | Gitelis | B65D 35/30 222/209 |
| 2009/0110786 | A1 | 4/2009 | Wells | |
| 2009/0294484 | A1* | 12/2009 | Avairis | B65D 83/0011 222/390 |
| 2012/0111883 | A1 | 5/2012 | Kim | |
| 2012/0312839 | A1 | 12/2012 | Stehli, Jr. et al. | |
| 2013/0119091 | A1* | 5/2013 | Bowers, Jr. | B65D 83/0005 222/386 |
| 2013/0313258 | A1* | 11/2013 | Sines | B65D 81/22 220/288 |
| 2014/0131394 | A1 | 5/2014 | Wheeler | |
| 2014/0263374 | A1 | 9/2014 | Janning | |
| 2015/0166246 | A1* | 6/2015 | Vilinsky | B65D 81/3211 426/2 |
| 2017/0240340 | A1 | 8/2017 | Sawyers | |

FOREIGN PATENT DOCUMENTS

| | | |
|---|---|---|
| KR | 101318304 | 10/2013 |
| KR | 101342843 | 12/2013 |
| WO | 2007132172 | 11/2007 |
| WO | 2013144635 | 10/2013 |

* cited by examiner

FOOD CONTAINER AND DISPENSER

CROSS-REFERENCE TO RELATED APPLICATION

This application claims the benefit of U.S. Provisional Application No. 62/663,336 titled "Portable Food Container and Dispenser," filed Apr. 27, 2018 by the inventor herein, which application is incorporated herein by reference in its entirety.

FIELD OF THE INVENTION

This invention relates to food dispensers and packaging, and more particularly to hand-held food dispensers that are manually operable for ease of operation by a user.

BACKGROUND

A confluence of current trends and behaviors continue to propel food consumers to desire containers that further facilitate accessibility to easy eating as they navigate the demands of their busy lives, dietary considerations, and the daily constraints they find while negotiating all of the when and where's of eating. These constraints range from the assistive technology needs of disabled consumers that have physical limitations, to the wide variety of on- and off-premise settings and occasions in which general consumers find themselves constrained in terms of convenience, speed, ease of use, and portability. Sadly, in many occasions, consumers are left with choices such as: contending with limited flat surfaces and trying to keep level unsteady containers on their laps; trying to eat when having to keep their primary attention (and often their eyes) on something else; or the variety of commuting, event, and/walking around moments where there may be limitations of time, space, or even just having more than one hand to hold containers, use utensils, or even eat the food without spilling or wearing it.

The reality is that consumers seek the same measure of control over ingredients and ease of eating during these constrained times. Thus, there remains a need in the art for portable food carriers capable of packaging, for example, a single serving of a variety of snacks or meals in a container designed for ease of use such that the consumer can eat the contents, and preferably that will allow one-handed operation to dispense food so as to maximize convenience in such circumstances as mentioned above.

SUMMARY OF THE INVENTION

Disclosed herein is a food container and dispenser that offers an intuitive tool that helps consumers manage the pace and success of eating, thereby enhancing rather than stressing the eating experience in these occasions. In accordance with certain aspects of an exemplary embodiment, a preferably portable food carrier is provided that includes a flexible, compressible outer container body and an internal lift. Preferably, the lift has a tapered lower wall that is particularly configured to allow a user to grasp the carrier and squeeze the container body at the location of the taper, causing the lift to move upward in the container, in turn pushing food product located above the lift toward an open, top mouth of the container, where the user may then access and eat the food product. The lift is configured to interact with the interior of the container in such a way so as to assist in providing smooth movement as the user squeezes the outside of the container, thus making it optimized for use with only one hand when the user is either on the go or is otherwise constrained.

In accordance with certain aspects of an embodiment, a hand-held food dispenser optimized for one-handed operation is provided, comprising: a container having one or more manually compressible exterior walls; a lift inside of the container and engaging an interior of the container such that manual compression on the outside of the container by one hand of a user causes the lift to move along a length of the container, wherein an outer surface of the lift conforms to the interior surface of the container; wherein the interior of the container defines a lift engaging surface that is configured to allow linear, bidirectional movement of the lift within the container.

In accordance with further aspects of an embodiment, a hand-held food dispenser optimized for one-handed operation is provided, comprising: a container having a manually compressible exterior wall; a lift inside of the container having at least a first tapered wall and engaging an interior of the container such that manual compression on the outside of the container by one hand of a user causes the lift to move along a length of the container; and a flexible bag positioned within the interior of the container; wherein the lift engages the flexible bag such that movement of the lift within the container moves dispensable food within the flexible bag toward an open top end of the container.

In accordance with still further aspects of an embodiment, a hand-held food dispenser optimized for one-handed operation is provided, comprising: a container having a manually compressible exterior wall; a lift inside of the container and engaging an interior of the container such that manual compression on the outside of the container by one hand of a user causes the lift to move along a length of the container, the lift having a top wall having a top edge, a bottom edge, and a side wall extending from the top edge to the bottom edge, wherein at least a portion of the side wall conforms to the interior surface of the container, and a tapered lower wall extending down from the bottom edge of the top wall and terminating in a tapered lower wall bottom edge; wherein the interior of the container defines a lift engaging surface that is configured to allow linear, bidirectional movement of the lift within the container.

In accordance with yet further aspects of an embodiment, a hand-held food dispenser optimized for one-handed operation is provided, comprising: a container having a manually compressible exterior wall and having a bottom end and an open top end; and a lift inside of the container and engaging an interior of the container such that manual compression on the outside of the container by one hand of a user causes the lift to move along a length of the container; wherein the open top end of the container has an open top end perimeter that is smaller than a perimeter of the lift; and wherein the lift is manually removable from the container through the lip.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized. The present invention is illustrated by way of example, and not by way of limitation, in the figures of the accompanying drawings, in which like reference numerals refer to similar elements, and in which:

DETAILED DESCRIPTION OF THE PREFERRED EMBODIMENTS

The invention may be understood by referring to the following description and accompanying drawings. This description of an embodiment, set out below to enable one to practice an implementation of the invention, is not intended to limit the preferred embodiment, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Descriptions of well-known functions and structures are omitted to enhance clarity and conciseness. The terminology used herein is for the purpose of describing particular embodiments only and is not intended to be limiting of the present disclosure. As used herein, the singular forms "a", "an" and "the" are intended to include the plural forms as well, unless the context clearly indicates otherwise. Furthermore, the use of the terms a, an, etc. does not denote a limitation of quantity, but rather denotes the presence of at least one of the referenced item.

The use of the terms "first", "second", and the like does not imply any particular order, but they are included to identify individual elements. Moreover, the use of the terms first, second, etc. does not denote any order of importance, but rather the terms first, second, etc. are used to distinguish one element from another. It will be further understood that the terms "comprises" and/or "comprising", or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Although some features may be described with respect to individual exemplary embodiments, aspects need not be limited thereto such that features from one or more exemplary embodiments may be combinable with other features from one or more exemplary embodiments.

Figure 2:
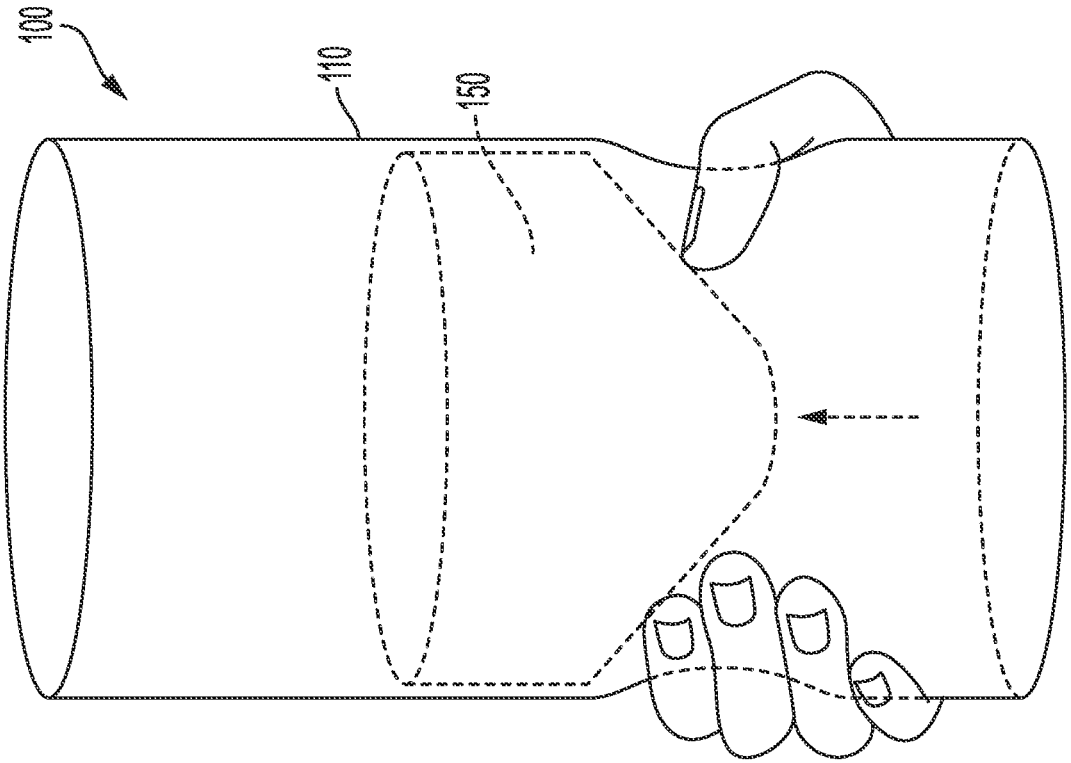
FIG. 2 is a side view of the food container and dispenser of FIG. 1 with the lift shown in a partially raised position.
Figure 1:
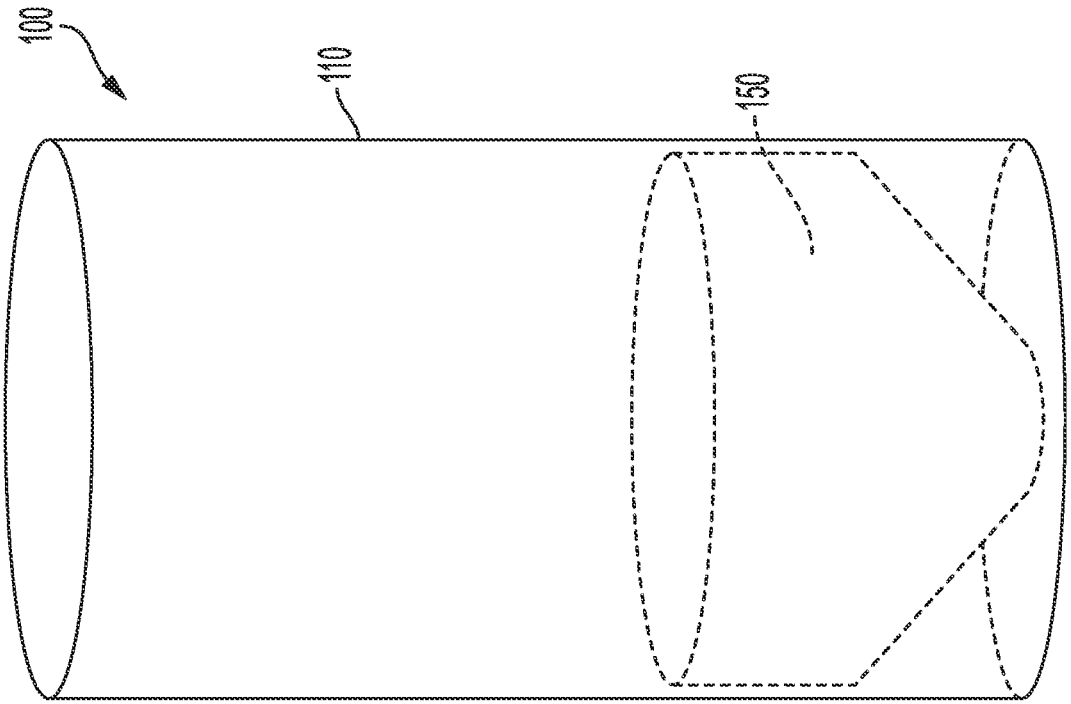
FIG. 1 is a side view of a food container and dispenser in accordance with certain aspects of an embodiment of the invention.

By way of summary, and with reference to FIG. 1, disclosed herein is a food dispensing system 100 that includes a flexible, manually compressible external container body 110 and an internal lift 150 that is moveable inside and along at least a portion of the length of the container body 110. Lift 150 is preferably sufficiently rigid so as to not permanently deform or lose its structural integrity when external container body 110 is manually compressed with sufficient force to move lift 150 within container body 110. In use, the lift 150 is initially positioned at a location within the container so as to define a volume between the top of the lift and the top of the container, which volume is sufficient to preferably and in exemplary embodiments hold a meal or snack sized portion of food, such as for example ½ to 4 cups of food product, that a user wishes to consume using the food dispensing system 100. Of course, other sizes of food portions may likewise be used without departing from the spirit and scope of the invention. For example, lift 150 may be initially positioned at the bottom of the interior of container body 110, with food product loaded into the container body 110 on top of lift 150. With the food product positioned inside of the container body 110 and atop the lift 150, the user may gradually squeeze or pinch the outside of the flexible, manually compressible container body 110, as shown in FIG. 2, at a location below the top surface of the lift 150 so as to cause the lift to move upward in the container body 110. Doing so, in turn, pushes the food product 10 toward the open top of the container body 110 to allow the user to progressively access and consume the food product. Such a configuration allows easy, one-handed operation of the food dispensing system 100, providing the user a comfortable, easy to use, non-messy dispensing tool for consuming food while, for example, on the go or otherwise constrained.

As shown in FIG. 1 and FIG. 2, and in accordance with certain features of an embodiment, the outer-most edge of lift 150 is preferably of a dimension that generally matches the internal perimeter of container body 110, at least in the region of intended travel of lift 150 within container body 110. This creates a close tolerance between the outer perimeter of lift 150 and the interior of container body 110, which in turn substantially hinders food product from passing between lift 150 and container body 110 and ending up unused below lift 150.

Optionally, lift 150 may be configured having varying diameters, such as a larger diameter at an upper portion of lift 150 that comes into contact with food product in container body 110, and a smaller, lower portion of lift 150 that includes a tapered portion that interacts with the interior surface of the container body 110 when compressed inward to push lift 150 upward through container 110. In such optional configuration, container 110 may have a similar profile of a larger diameter in the upper portion of container 110, and a smaller diameter in the lower portion of container 110. Such a configuration may be useful where, for example, the food product to be used with system 100 is one that would typically be eaten from a bowl, with each squeeze by the user of the outside of container body 110 raising the bottom portion of the bowl (i.e., the top face of lift 150).

An important feature of the invention is the interaction between the lift 150 and the container body 110 that both eases operability, so that a user may easily push food 10 toward the open top of the container body 110 with a one-handed, intuitive pinching motion, preferably assisting the user in maintaining smooth movement of lift 150, and without the lift 150 tilting, rolling, or jumping as it travels along the length of the interior of the container body 110. In certain configurations, the interaction between lift 150 and container body 110 is such so that a holding force also exists (e.g., as a result of friction between the lift 150 and the interior of the container body 110) so that the lift 150 remains at its location when the user stops applying external pressure on the outside of the container body 110, or at least retracts or reverses only a small amount (e.g., preferably not more than, for example, 2.5 cm) from such location when the user stops applying external pressure on the container body 110. Likewise, the interaction between the lift 150 and the container body 110 further allows the lift 150 to reverse direction if the user manually pushes the lift 150 back towards the bottom of the container body 110 (such as by applying external pressure on the outside of the container body 110 at a location above the top surface of the lift 150), which may be desirable to lower the level of food product downward and away from the top mouth of the flexible sleeve when a user wishes to save some of the food product for later consumption.

With such a configuration, a user, by simply squeezing the sides of the exterior of the container body 110 with their one or more hands, can control the lift 150 so that the food product is moved upward toward the open top of the container body 110 and eaten at the desired pace or otherwise controlled and/or positioned down or to an optimal position, for example for rest and/or transport. While it is envisaged that any edible product may be placed in such a system 100, by way of non-limiting example, exemplary characteristics of such foods that might be carried and dispensed by such system may include those having some moisture and/or that easily come apart and/or are hard to consume with one hand or with limited dexterity, or that are messy because of their consistency, are comprised of numbers of small pieces, or include sauces/juices or toppings or crumbliness, and/or that could otherwise be unwieldy without eating utensils or because of physical constraints that might limit the overall mobility of the user (such as when they are standing or sitting without the use of a table) to hold the food and fully use their arms and/or hands. Again by way of non-limiting example, such foods could include items such as: salads with dressings and/or other toppings; the types of ingredients that often come mixed and served in wraps or bowls; or similarly comprised combinations of bite sized ingredients mixed with seasonings, condiments, and/or sauces.

Container body 110 is preferably formed of a material having a wall thickness and a balance of flexibility and rigidity such that the sides of container body 110 can be squeezed by a hand applying pressure above or below the position of lift 150 in order to control and move lift 150 in the desired direction, and optionally to cause lift 150 to stay at a desired location within container body 110, yet maintain its shape in holding contents and in standing alone, without collapsing, on for example a flat surface such as a table, a cup holder, or the like. By way of non-limiting example, container body 110 may be made of materials such as cardboard, foils, polymers, silicones, combinations of the foregoing, or any other type of material that is sufficiently flexible to allow the user to control the movement of the lift 150 by applying hand pressure to the outside of container body 110, yet is preferably rigid enough to hold its shape while sitting on its base at rest.

Figure 3:
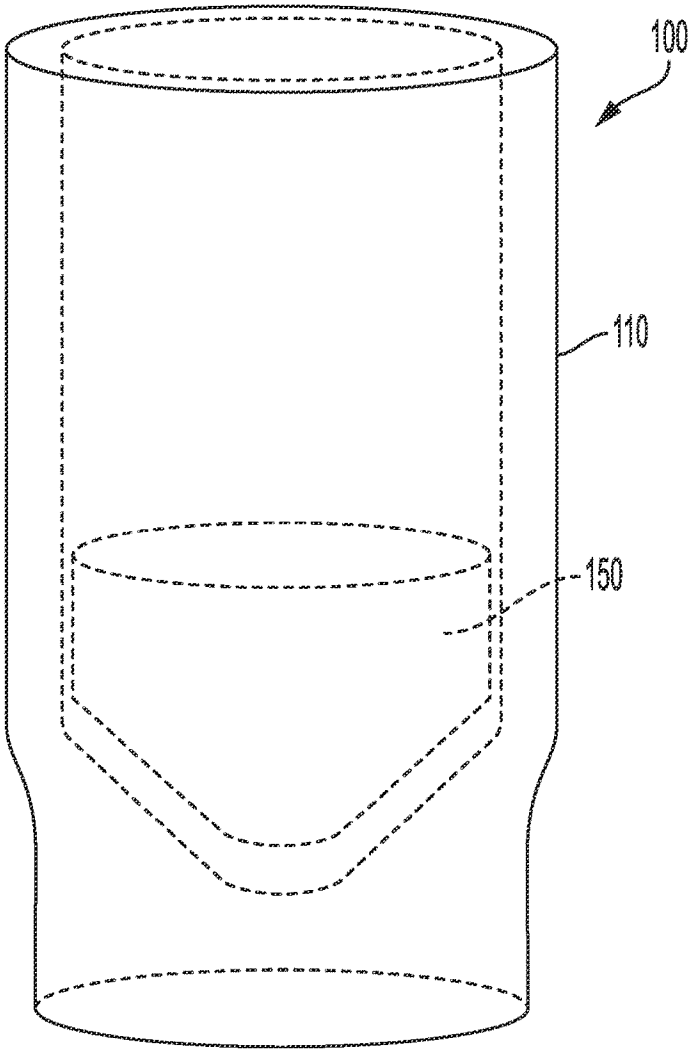
FIG. 3 is a side view of a food container and dispenser in accordance with further aspects of an embodiment of the invention.

In certain configurations, both the interior and exterior surfaces of container body 110 may take the shape of a hollow cylinder that may have, for example, a circular base capable of standing container body 110 upright. However, alternative cross-sectional shapes, such as octagon, oval, rectangular, etc., and possibly varying cross-sectional shapes along the length of container body 110, may be used without departing from the scope of the invention in order to meet a particular user's functional or aesthetic purposes. Further depending on the application and material, the external shape of container body 110 may match the internal shape of container body 110, or alternatively the external shape may include contours designed to assist the user in the controlled movement of the lift 150 and/or to meet other ergonomic or aesthetic purposes. By way of non-limiting example, and with reference to FIG. 3, the exterior of container body 110 may include a narrowing of the external dimension of the sleeve just below the height level where the tapering section of the lift 150 begins when the lift 150 is at rest at the base of the container body 110, such that a hand holding the container body 110 at the base can easily begin the process of raising lift 150 inside of container body 110.

Likewise, container body 100 may include a bottom wall forming a base of container body 100, or alternatively in certain configurations may have an open bottom. Preferably, in each configuration, the walls of container body 100 maintain sufficient rigidity to hold the overall upright shape of container body 110 when not supported by the user.

Container body 100 preferably has an overall length (from top to bottom) that optimally enables easy operation by an adult with one hand; however, depending on the use case, it may also be practical to operate using two hands. Further, while it is imagined that the pressing pressure applied to the container body 110 to move lift 150 will be achieved by the use of a user's hands, it is also conceivable that such movement of lift 150 may be achieved by a non-human mechanical force, device, or source of pressure.

Figure 4A:
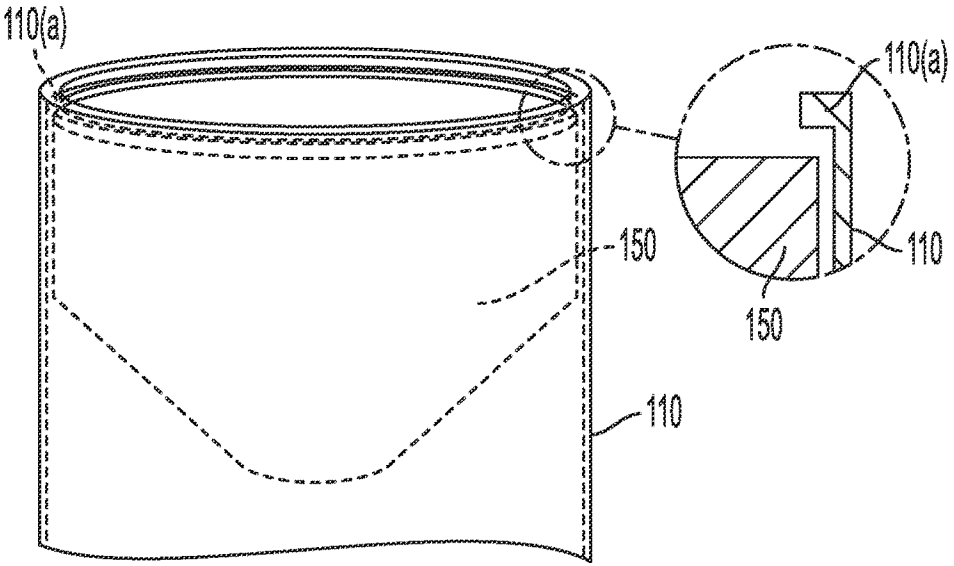
FIGS. 4A and 4B are close-up views of the top portion of a food container and dispenser in accordance with further aspects of an embodiment of the invention.
Figure 4B:
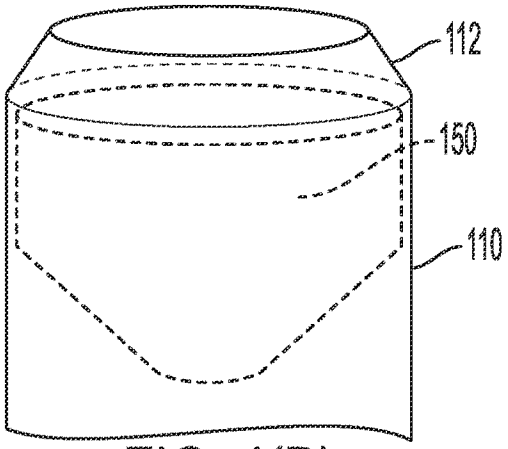
Figure 5:
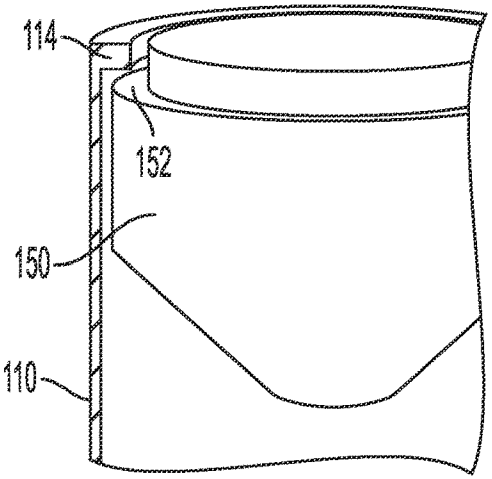
FIG. 5 is a close-up, partial sectional view of the top portion of a food container and dispenser in accordance with still further aspects of an embodiment of the invention.

Next, and as shown in FIG. 4A, the top end of container body 110 may have a configuration that prevents lift 150 from "popping" out through the top end of container body 110 during use, particularly by making the width of the top, open end of container body 110 narrower than the widest portion of lift 150. More particularly, the top end of container body 110 may have a rim 110(*a*) that extends inward from the outer, vertical wall of container body 110 at the open end of container body 110, which rim defines an opening having a smaller perimeter than the widest perimeter of lift 150. As a further option, the top end of container body 110 may have a narrowing wall section 112, as shown in FIG. 4B, which narrowing wall section 112 defines an opening having a smaller perimeter than the widest perimeter of lift 150. Still further, and as shown in FIG. 5, the top end of container body 110 may include a lip 114 that extends inward from the outer wall of container body 110, and lift 150 may include a stop wall 152 at its upper end sized to engage the bottom of lip 114, thus allowing the top-most surface of lift 150 to reach the very top of container body 110 while still preventing its inadvertent movement past the top-most edge of container body 110. In certain configurations, container body 110, and particularly the open, top end of container body 110, has sufficient flexibility that it will stretch upon application of manual force (e.g., in a radial direction) to allow removal of lift 150 from inside of container body 110, but will maintain its shape with a smaller perimeter than that of lift 150 absent the application of such an intentional, disfiguring force. Thus, the open end of container body 110 will allow relatively easy removal of lift 150 from the system 100 when desired (e.g., for cleaning and subsequent reuse), but will hinder inadvertent exit of lift 150 from container body 110 without such intentionally applied force.

Figure 6B:
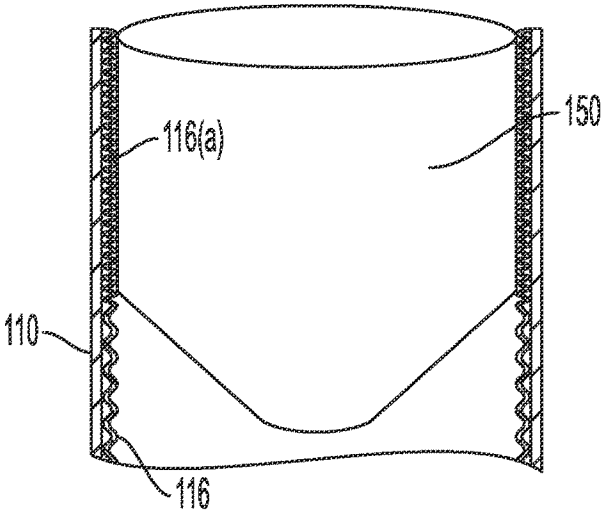
FIGS. 6A and 6B are a close-up, sectional views of a food container and dispenser in accordance with further aspects of an embodiment of the invention.
Figure 6A:
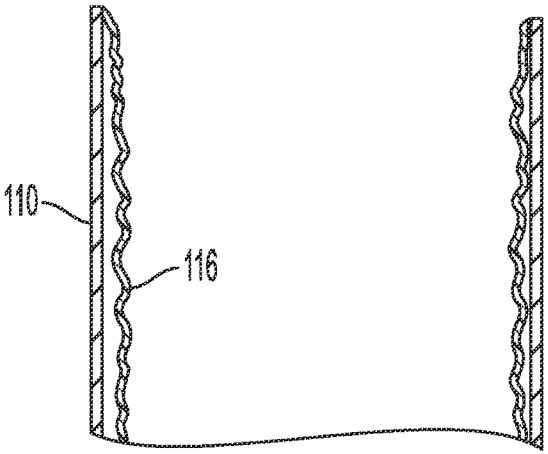

Optionally, and in accordance with certain features of an embodiment, the walls of container body 110 may be comprised of multiple layers that may be laminated or similarly joined to one another, or alternatively may be attached to one another only at limited locations such that portions of one or more layers hang free from an adjacent layer. For example, and as shown in FIGS. 6A and 6B, the interior of container body 110 may include an interior layer 116 closest to lift 150 that is held to the interior of container body 110 at least at the top-most portion of the interior wall of container body 110, but in at least some other portions is not attached to the next outer layer of container body 110. Thus, portions of interior layer 116 may move with respect to the interior of container body 110. As a result, as lift 150 moves within container body 110, inner layer 116 will tend to regionally bunch (as shown at 116(*a*) in FIG. 6B) wherein it aligns with the upper portion of lift 150, in turn lightly binding lift 150. Such binding force is easily overcome by the user intentionally applying force to the outside of container body 110, but upon removal of such force, the binding resulting from loose portions of inner layer 116 will aid in keeping lift 150 at the position at which it was left when the user stopped applying an external force.

In certain configurations, such inner layer 116 may also be joined to the next outer layer of container body 110 at, for example, the bottom of the inner layer 116, and optionally at still other locations throughout the length of inner layer 116, such that inner layer 116 is permanently joined to the interior of container body 110.

Figure 7B:
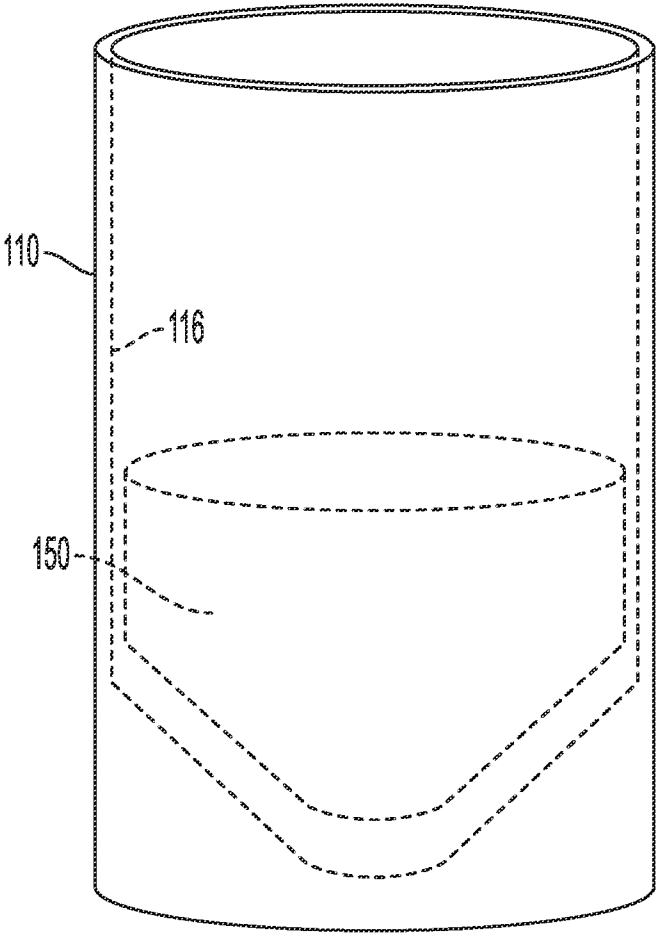
FIGS. 7A and 7B are side views of a food container and dispenser in accordance with further aspects of an embodiment of the invention.
Figure 7A:
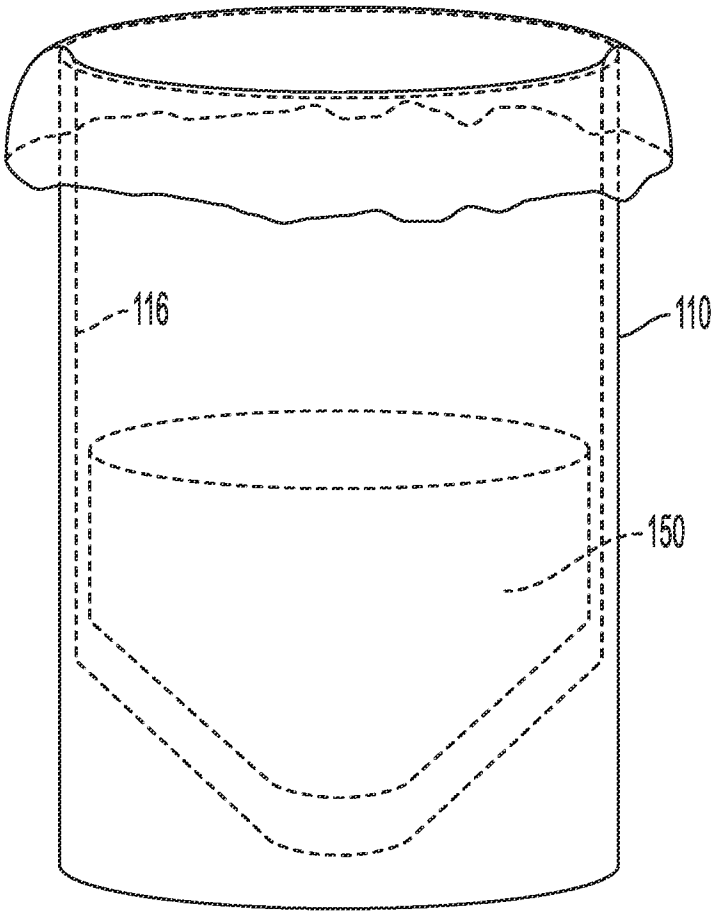
Figure 8:
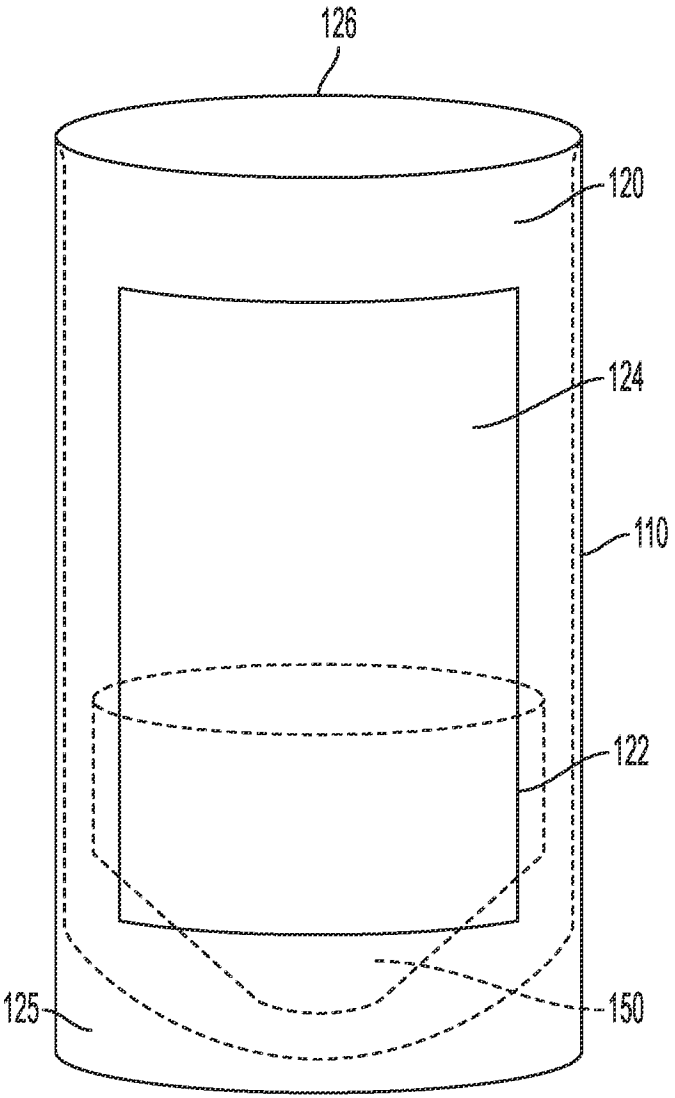
FIG. 8 is a side view of a food container and dispenser in accordance with still further aspects of an embodiment of the invention.

In other configurations, such inner layer 116 may comprise a disposable "baggie" liner or flexible wall cartridge that is inserted inside the container body 110, as shown in FIGS. 7A, 7B, and 8. Once the baggie or cartridge is inserted, the lift 150 is then loaded inside the liner and pressed down to the bottom of the interior of the container body 110, followed by loading the food on top of the lift 150 and inside the baggie. Alternatively, the baggie or cartridge may be provided preloaded with the lift 150, with or without food product. Optionally, the bottom of the baggie may be removably attached to the container body 110, such as by way of non-limiting example use of a glue dot on the bottom, exterior of the baggy, complementary sections of hook-and-loop fastening material on the bottom, exterior of the baggy and the bottom of the interior of the container body 110, or such other temporary fixation devices as may occur to those skilled in the art. As explained above, in some configurations the baggy liner may tend to displace with respect to the interior wall of container body 110, resulting in localized binding of the baggie material against lift 150 which will supplement the holding force between the interior of container body 110 and lift 150, such that lift 150 remains stable and in place during both movement and in the resting position. In addition, the baggy may be fitted by combination of custom sizing to match the shape of the top, open end of container body 110 (as shown in FIG. 7A) and/or through use of a connecting attachment applied to the top, open end of container body 110 (as shown in FIG. 7B), and such that the top of the bag remains reliably in place during rest or movement of the lift 150 in either direction.

With respect to further features of an embodiment, and with reference to FIG. 8, container body 110 may include an outer layer 120 and inner layer 124, where inner layer 124 is of greater flexibility than outer layer 120. For example, outer layer 120 may be formed of semi-rigid cardboard or heavy paper stock, while inner layer 124 may be formed of baggie material, foil, or other highly flexible material, having an interior dimension with close tolerance to the outermost perimeter of lift 150. In this configuration, outer layer 120 may optionally include openings 122 in both a front face 125 and a back face 126 of outer layer 120, which openings allow direct contact with inner layer 124 for enabling a user to easily squeeze container body 110 to move lift 150 as desired. In this configuration, inner layer 124 may optionally form an interior pouch (optionally including a pre-packaged meal already positioned inside of inner layer 124, with or without lift 150) that may be slipped into outer layer 120 and removed after use, such that outer layer 120 may provide a reusable carrier for food dispensing system 100.

Alternatively, inner layer 124 may extend only over openings 122 in front face 125 and back face 126, and thus be permanently affixed to an interior of outer layer 120 (in, for example, a food dispensing system 100 that is entirely configured as a disposable item).

Figure 9:
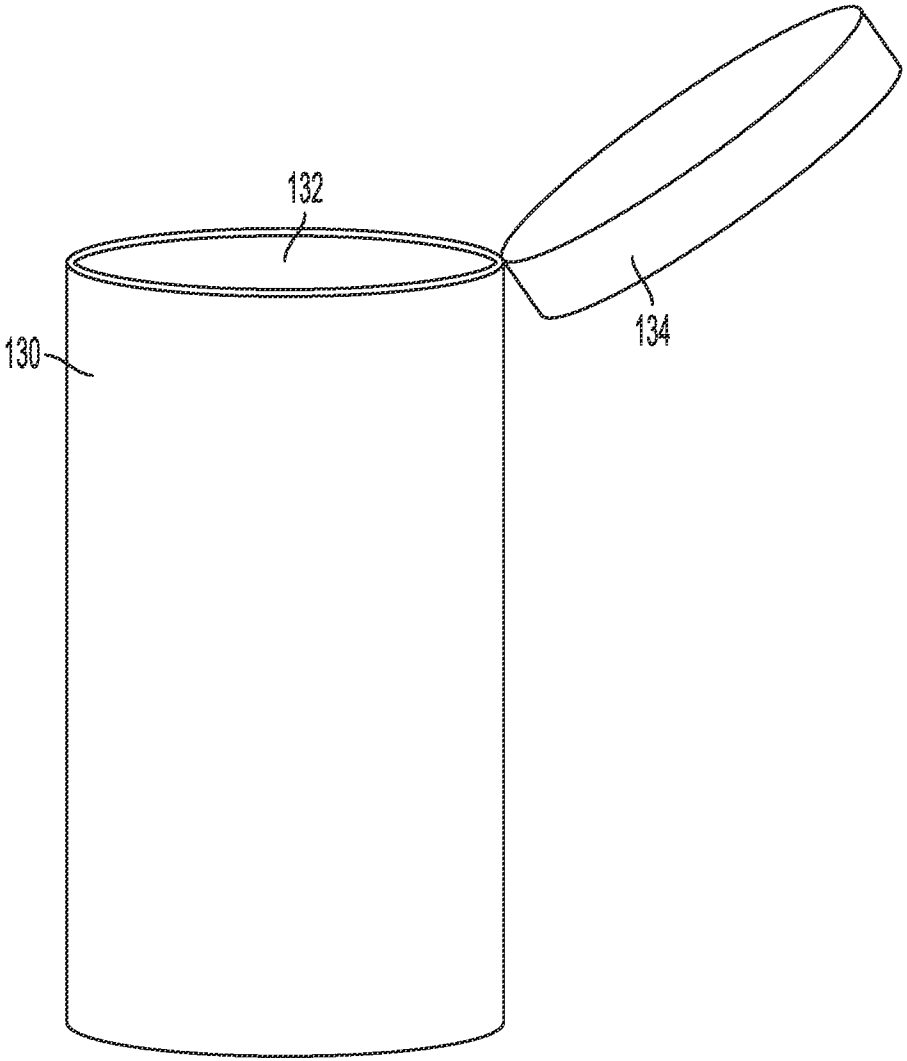
FIG. 9 is a side view of an insulting layer of a food container and dispenser in accordance with further aspects of an embodiment of the invention.

In still other configurations, a receptacle 130 having thermally insulating material 132 on an interior or exterior of such receptacle 130 may be provided, as shown in FIG. 9, that removably houses container body 110. Receptacle 130 may include a thermally insulated lid 134 that may close the open top of receptacle 130. For example, lid 134 may be equipped with a zipper or similarly configured closure device that engages a complementary element on the body of receptacle 130. Likewise, in certain configurations, one or more layers of container body 110 may comprise a thermally insulating material.

Figure 10:
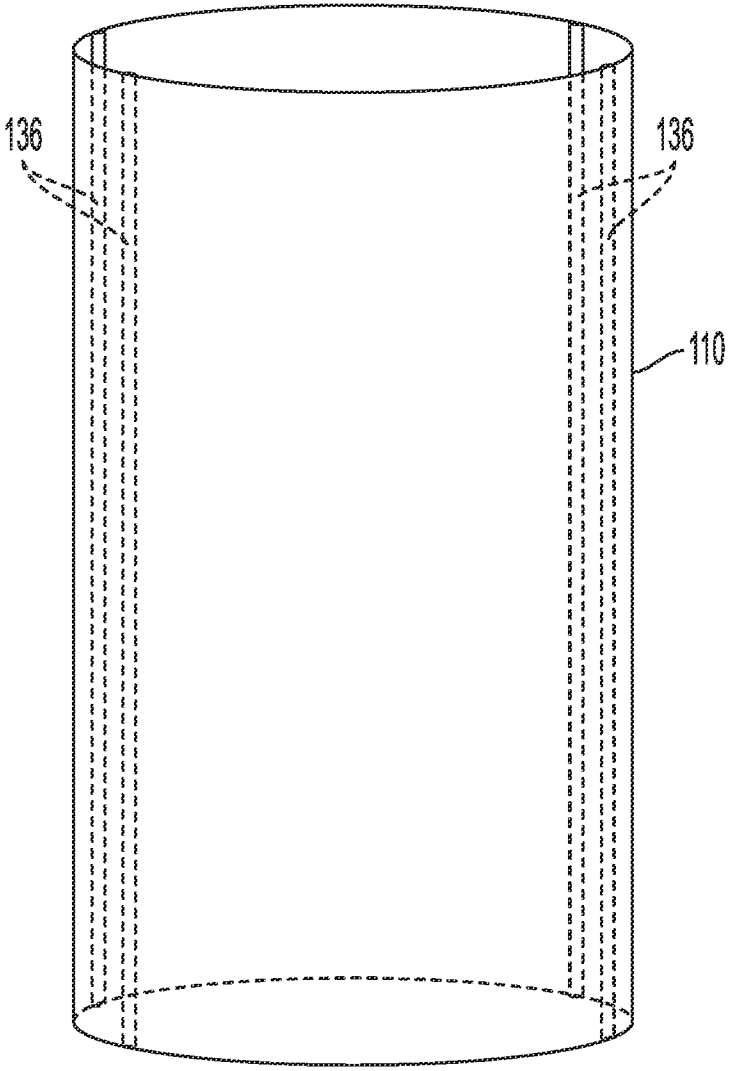
FIG. 10 is a side view of a food container and dispenser having vertical elements in accordance with further aspects of an embodiment of the invention.

In certain embodiments, it may be desirable to provide strengthening along the walls of container body 110 to ensure that it is able to maintain its vertical shape when not being manipulated by a user. To that end, and as shown in FIG. 10, vertical elements 136 having greater rigidity than container body 110 may be embedded within the walls of container body 110, particularly at the side ends of container body 110 that are orthogonal to the sides that the user will squeeze in order to move lift 150. Such vertical elements 136 may, by way of non-limiting example, be formed of thin sections of wood, plastic, or such other preferably inexpensive materials as may occur to those skilled in the art, and that will add sufficient rigidity to container body 110 to ensure that it will maintain its upright shape when standing unsupported by a user's hand.

Figure 11:
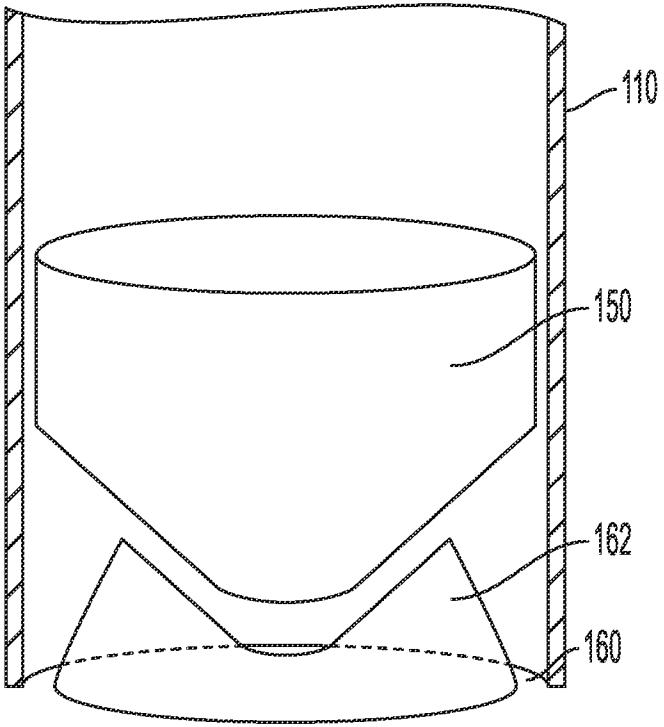
FIG. 11 is a side view of a bottom portion of a food container and dispenser in accordance with further aspects of an embodiment of the invention.

As mentioned above, container body 110 also preferably may have a base that is configured to aid in allowing food dispensing system 100 to stand upright when unsupported. For example, a bottom surface 111 (FIG. 1) of container body 110 may be of unitary construction with the vertical walls of container body 110, particularly where the entirety of container body 110 is of sufficient rigidity so as to maintain its upright shape when unsupported by a user. By way of non-limiting example, container body 110 may be formed of cardboard, and the bottom surface of container body 110 may comprise folded sections of cardboard that extend downward from the side walls of container body 110, such that container body 110 may be folded flat when not in use (e.g., for purposes of shipping multiple units of system 100 in a flat, stacked package prior to use). Alternatively, a separate base 160 may be provided as shown in FIG. 11, having a bottom plate that matches in shape the perimeter of container body 110. In such a configuration, the bottom plate of base 160 may optionally be formed of a material having greater rigidity than the vertical walls of container body 110, such as thermoplastic or other such preferably inexpensive, rigid, light-weight materials as may occur to those skilled in the art. By affixing the bottom edge of the sidewalls of container body 110 to the bottom plate of base 160, the walls of container body 110 will maintain their intended shape despite having sufficient flexibility to allow a user to easily squeeze them to move lift 150.

Optionally, base 160 may also include a nesting mount 162 having a notch configured to receive the bottom, tapered portion of lift 150. Nesting mount 162 may serve to optimally position lift 150 inside of container body 110 so as to allow the user to readily grasp and initiate movement of lift 150 inside of container body 110.

Further, base 160 may preferably have an outer perimeter that is sized for fitting within, for example, a standard cup holder. A bottom edge of the walls of container body 110 may thus be joined to the perimeter edge of base 160 (as shown in FIG. 11), or optionally to the top, planar face of base 160 at a location inward from the outer perimeter edge of base 160.

Figure 12:
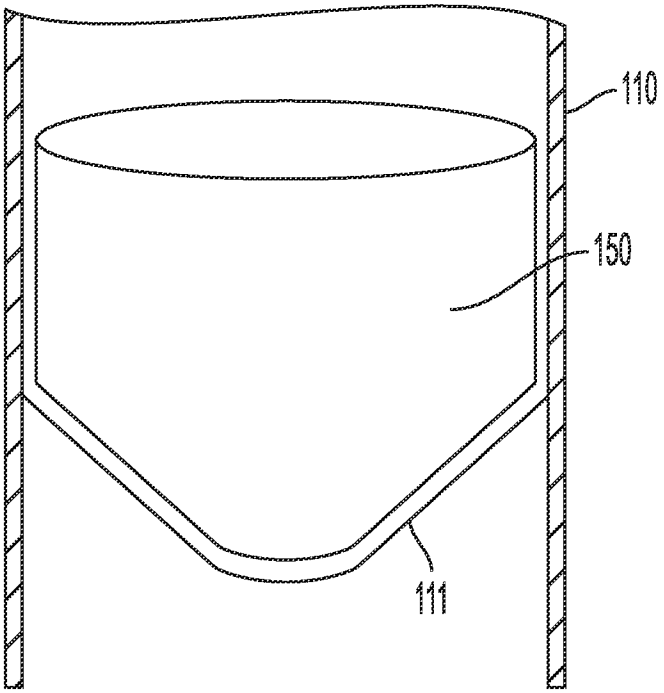
FIG. 12 is a side view of a bottom portion of a food container and dispenser in accordance with still further aspects of an embodiment of the invention.

Alternatively, in those configurations in which the bottom surface of container body 110 is formed unitarily with the vertical walls of container body 110, the interior, top face of that bottom surface may itself include a tapered bottom 111 as shown in FIG. 12 to mirror the bottom external shape of the lift 150. Further, in those configurations in which the bottom surface of container body 110 is formed unitarily with the vertical walls of container body 110, that bottom surface may preferably have an outer perimeter that is sized for fitting within, for example, a standard cup holder.

Figure 13:
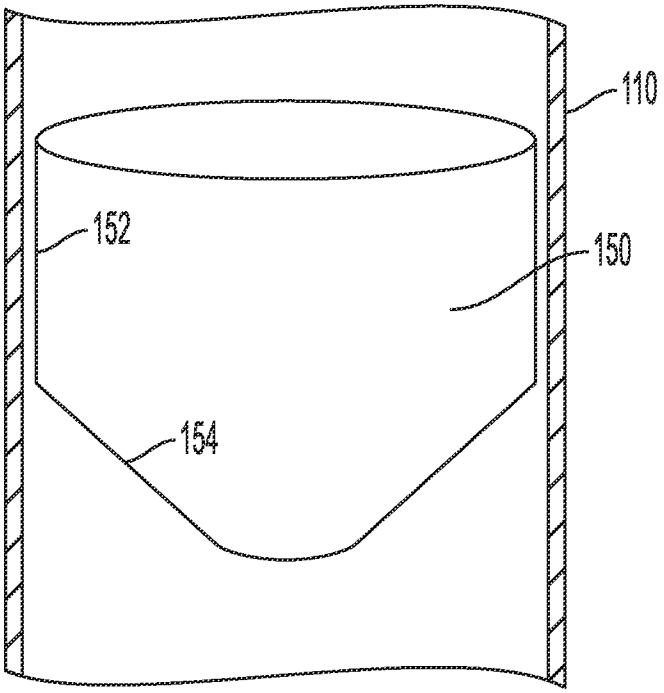
FIG. 13 is a side view of a lift inside of a food container and dispenser in accordance with certain aspects of an embodiment of the invention.

Next, and with reference to FIG. 13, lift 150 is preferably made of a solid material with very smooth (antifriction) surfaces. In an exemplary embodiment, the top portion of lift 150 forms a generally vertical collar 152 that is preferably a minimum of, for example, 1-3 cm high, which collar 152 allows the lift 150 to slide uniformly within the interior of container body 110 without tilting over in the process. The bottom of lift 150, beginning at the bottom of the collar 152, is preferably tapered (as shown at 154) to enable the user to gradually "push" the lift 150 upward in container body 110, in a controlled way, by squeezing the sides of the exterior of container body 110 below the collar 152, with their hand. As the container body 110 may come in a variety of shapes and sizes, the actual total height of the collar 152 and bottom, tapered portion 154 of the lift 150 necessary to limit tilting will be, in part, a function of the amount of the lift 150 that will be touching the inner wall of container body 110 as it glides, and that measurement's proportion to the internal horizontal diameter dimension of the interior wall of the container body 110. Further, the diameter of the collar 152 of the lift 150 is of a dimension substantially matching the diameter of the internal cavity of the container body 110, meaning preferably within a 1 cm tolerance between the external wall of the lift 150 and the internal wall of the container body 110 (although such tolerance could be more in the case where there also exists a detachable container sleeve wall liner, as discussed above).

Figure 14A:
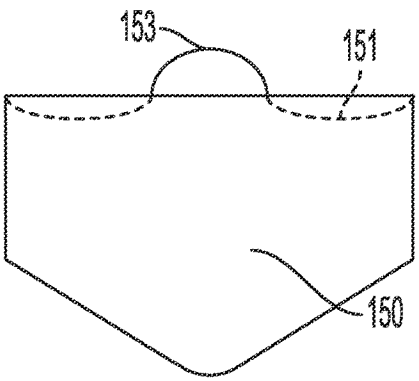
FIGS. 14A-14C are side views of a lift for use with a food container and dispenser in accordance with further aspects of an embodiment of the invention.
Figure 14B:
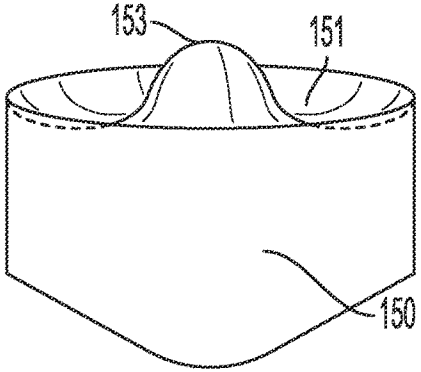
Figure 14C:
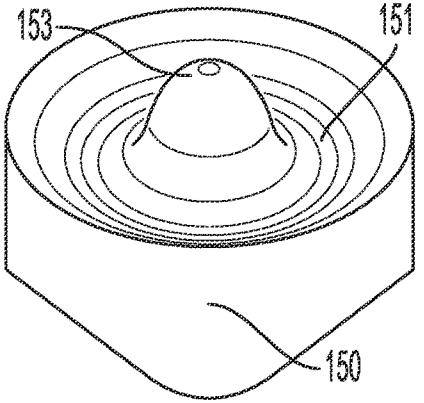
Figure 15A:
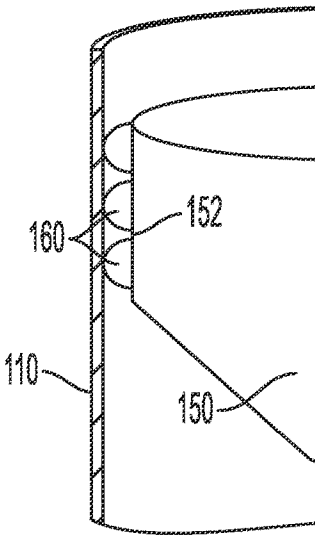
FIGS. 15A-15C are side views of a lift inside of a food container and dispenser in accordance with still further aspects of an embodiment of the invention.
Figure 15B:
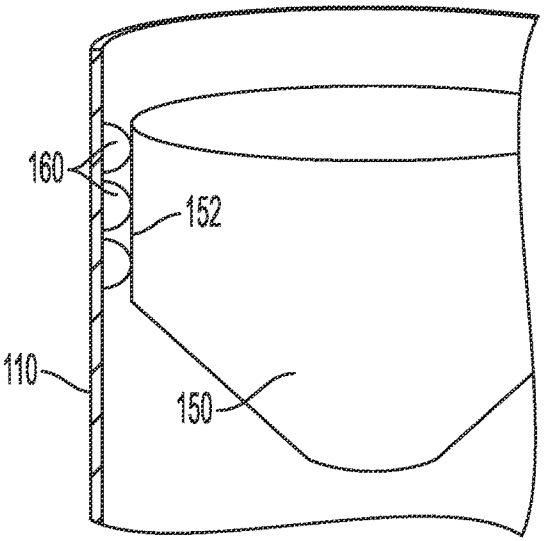
Figure 15C:
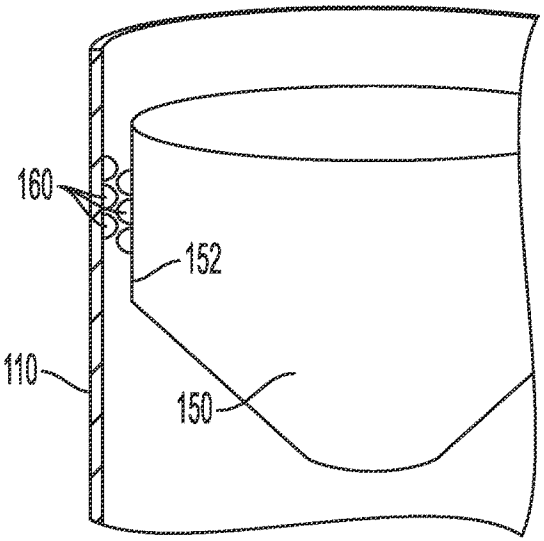

The top surface of lift 150 may be flat, or may possess a concave shape such that food tends to center as it rests on the platform or is elevated toward the open top face of the container body 110. Alternatively, the top surface of lift 150 may optionally include a "moat" having a conically shaped raised portion 153 in the middle, surrounded by a trough-like ringed depression 151, and then bounded on the outside by the rim of the collar of lift 150, as shown in FIGS. 14A through 14C. In addition, and as shown in FIGS. 15A through 15C, lift 150 may also have a variety of lift gripping members 160, which lift gripping members 160 may comprise, by way of non-limiting example, bumps, bubbles, bristles, rings, gaskets, or similarly configured protrusions coming out of the sides of the collared section 152 of lift 150 (as shown in FIG. 15A) to create additional stopper action to assist in controlling the elevation both in movement and at rest within the container body 110. Likewise, collar 152 of lift 150 may be smooth as discussed above, and the interior wall of container body 110 may be provided similarly configured lift gripping members 160 (as shown in FIG. 15B) extending into the interior of container body 110 to provide such additional stopper action against lift 150. Even further, both collar 152 of lift 150 and the interior wall of container body 110 may be provided similarly configured lift gripping members 160 (as shown in FIG. 15C) to provide such additional stopper action.

Figure 16C:
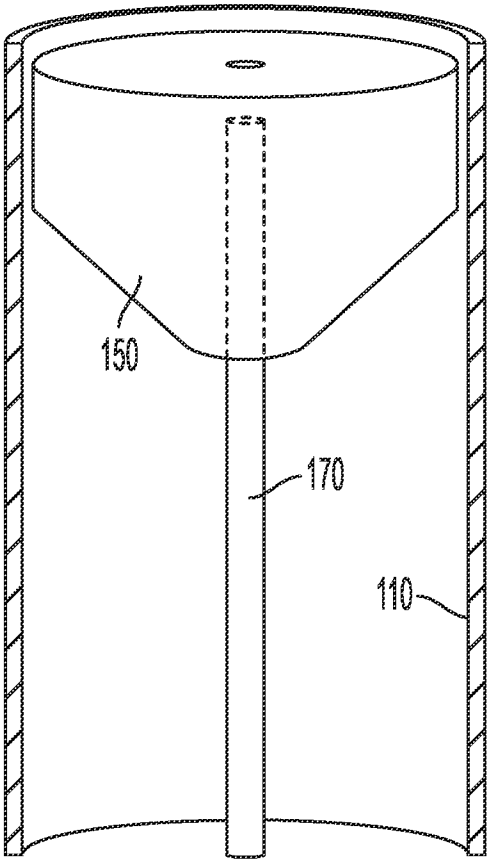
FIGS. 16A-16C are side views of a food container and dispenser including a lift guide rail in accordance with certain aspects of an embodiment of the invention.
Figure 16B:
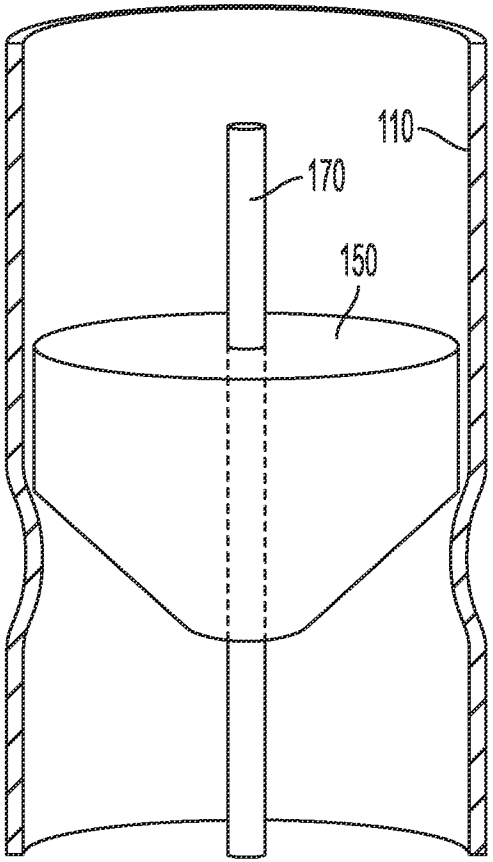
Figure 16A:
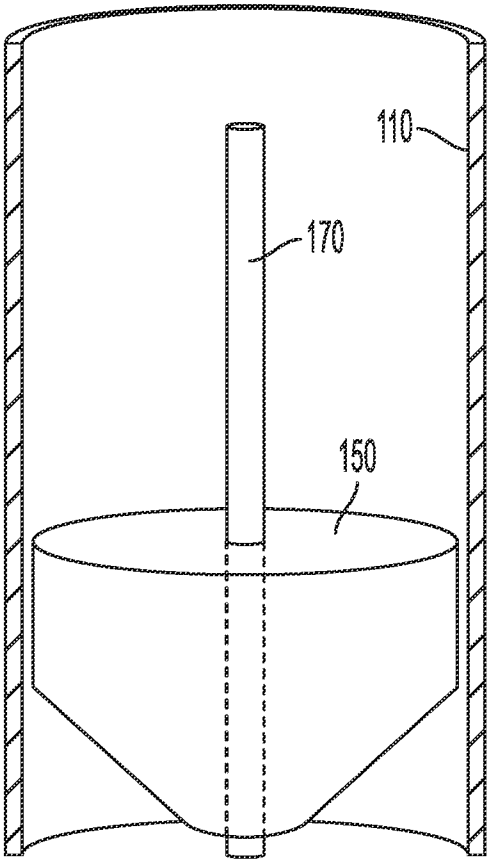

In other configurations and as shown in FIGS. 16A-16C, a guide rail (or rails) 170 can be provided in support of movement of lift 150 (either internal or external to lift 150). In an exemplary embodiment, guide rail 170 may comprise a central rod secured to a base or to the center of the base of container body 110 with a correspondingly shaped hole extending through the center of lift 150, such that when lift 150 is placed into container body 110 with the rod 170 threaded through it, lift 150 is then guided by rod 170 when moving in either direction. Optimally and with continued reference to FIGS. 16A-16C, the length of such rod 170 is such that a portion remains in the body of lift 150 when the top of lift 150 approaches the top, open mouth of container body 110, but is likewise short enough such that the top of rod 170 remains well below the lip of container body 110, and therefore won't touch a user's mouth during eating.

Figure 18A:
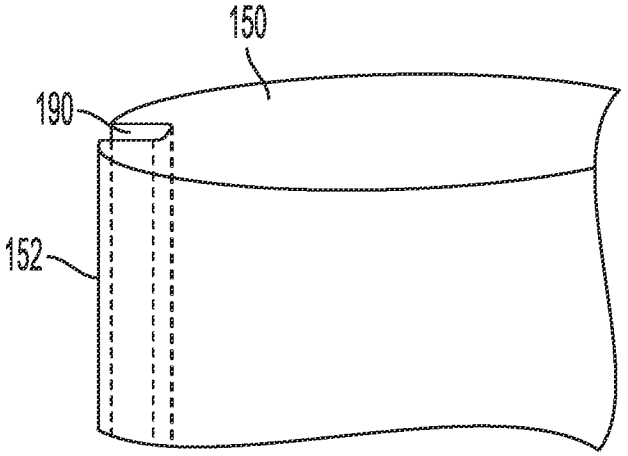
FIGS. 18A-18B are a partial side and a top view, respectively, of a lift for use with the food container and dispenser of FIG. 17.
Figure 18B:
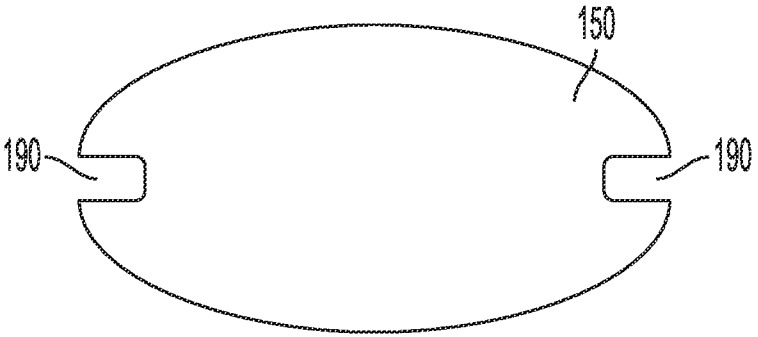
Figure 17:
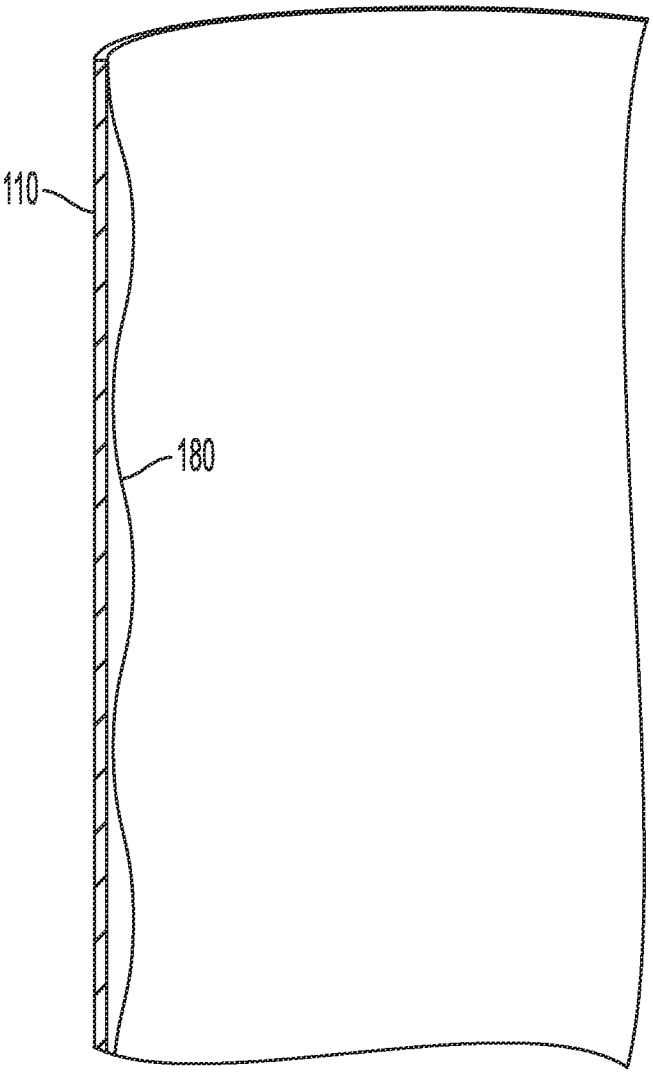
FIG. 17 is a partial side view of a food container and dispenser including a lift guide rail in accordance with further aspects of an embodiment of the invention.

In other configurations, and with reference to FIG. 17, lift gripping members 160 as discussed above may particularly comprise vertical rails 180 that extend along the interior vertical walls of container body 110, and that vary in width along their length. As shown in FIGS. 18A and 18B, in such configuration, lift 150 is provided notches 190 in each sidewall of collar portion 152, which notches 190 are sized to receive vertical rails 180 therein. Optionally, notches 190 may themselves have a contour that is complementary to the varying-width contour of vertical rails 180, e.g., a surface that provides a negative contour to the contour of vertical rails 180. The raised portions of vertical rails 180 are sized to minimally push against notches 190 in lift 150, thus providing both a guide for lift 150 as it travels through container body 110, and a holding force that gently squeezes the sides of lift 150 so as to hold it in place when the user stops applying squeezing pressure to the outside of container body 110. As container body 110 is generally sufficiently flexible to allow the user to squeeze the same to move lift 150, the force necessary to overcome the squeezing force applied by vertical rails 180 against the sides of lift 150 is low and thus will not prevent the user from easily raising or lowering lift 150 inside of container body 110, but will still provide sufficient holding force when the user's squeezing force is removed to keep lift 150 at its current location inside of container body 110.

Lift 150 is preferably made of a material of sufficient rigidity such that it will move upon pressing the outside of container body 110, while retaining its shape, maintaining its dimension in conforming with the internal diameter of container body 110, and otherwise possessing sufficient protection from breaking down due to "pushing" pressure or becoming saturated by moisture as to impair such movement and/or otherwise become unstable as a food platform. By way of non-limiting example, lift 150 may be formed of rigid plastic. Optionally, in certain configurations, the lift 150 may be made edible or out of food (such as a crouton, for example) or even of a hollow rigid shell that is filled with something edible. Still further, lift 150 may itself define a hollow chamber that is covered with a manually removable cover, lid, film, or the like, such as (by way of non-limiting example) a removable plastic film, that keeps the contents of lift 150 separated from the food product above lift 150. When the user has consumed the food product and reveals the top of lift 150, they may then peel off the plastic film lid of lift 150 to access its contents, which could comprise a desert item, a toy or novelty item, or such other items as may occur to those skilled in the art. In still further configurations, lift 150 may define a hollow chamber without a cover, such that the open, top face of the lift 150 is defined by a top edge extending around the perimeter of the top of lift 150. In such an optional configuration, food product within container 110 may extend to the bottom of the hollow interior of lift 150, while lift 150 still functions as described above to direct food toward the open, top mouth of the container upon compression of the flexible outer walls of container 110.

Further, in certain configurations, lift 150 may be perforated from its top surface through to the bottom of lift 150 in order to allow fluid from food product above lift 150 to drain into a portion of container body 110 below lift 150, thus preventing excess liquid from being pushed toward the user and potentially overflowing out of the top of container body 110.

A food dispensing system 100 configured in accordance with at least certain aspects of the invention is optimized for one-handed operation by a user. More particularly, the tapered portion of lift 150 may maximize the efficiency one gains when properly matching the form of lift 150 to the hand's natural movement in applying pressure to the exterior of container body 110. The optimal lift 150 with taper shape then serves to balance both the level of platform and wall dimension, in relation to the container, necessary to remain stable in its glide through the container body 110, while providing the shape efficiency for the hand to maximize control and pace of movement. As a result, these considerations make up a unique and differentiating contribution to various configurations of the device, offering a significant improvement and enhancement to functionality and use.

A portable food container and dispenser, according to various aspects of an embodiment, may be designed in differing versions to be considered applicable to either reusable or disposable use cases, respectively. Such use cases may also inform the choice of materials and additional features of the portable food container and dispenser.

Figure 20:
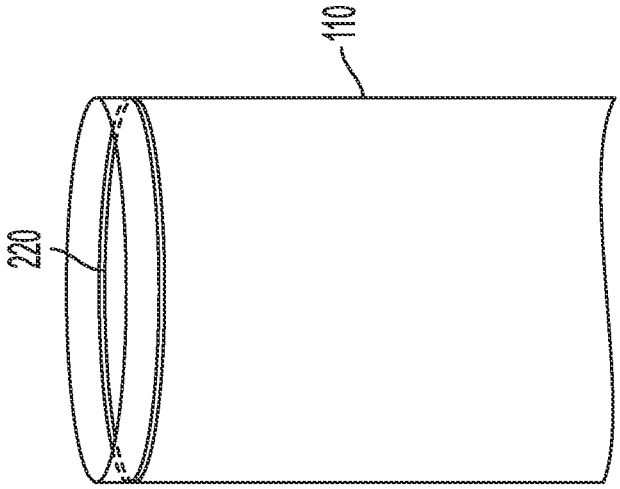
FIG. 20 is a side view of a food container and dispenser including a zip-lock closure in accordance with certain aspects of an embodiment of the invention.
Figure 19:
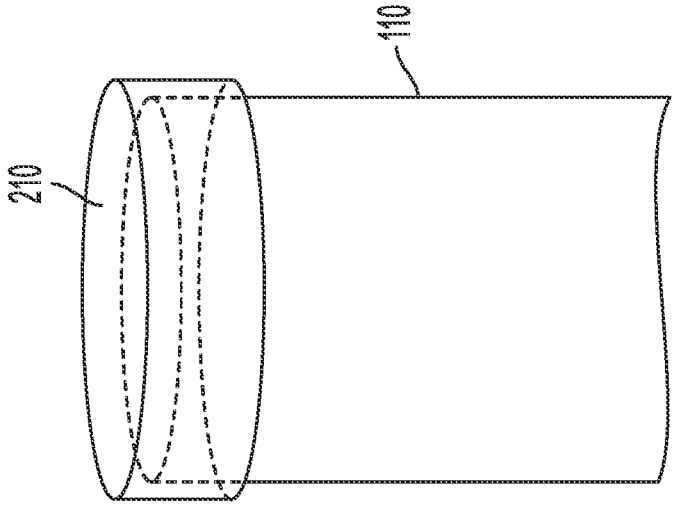
FIG. 19 is a side view of a food container and dispenser including a lid in accordance with certain aspects of an embodiment of the invention.

In some configurations, a sealed mouth enclosure may be provided that keeps food inside the container body 110 when not in use or during transport, as shown in FIGS. 19 and 20. In some embodiments, such enclosure can be either integrated into the container body 110 or affixed as a detachable accessory, and possesses either an attached or detachable cap/lid 210. Examples of such lids may include a threaded neck with a screw-on top or a simple, unthreaded, snap on cap (with or without a tether for the cap). Such lids 210 may be provided in a variety of versions, including but not limited to those where the base of the connection type (threaded or snap neck, for example) is either permanently integrated into the top, mouth section of the container body 110, or as an accessory top that can be removed for cleaning, for example. Another type may comprise a zip-lock style resealable enclosure 220 as shown in FIG. 20.

Figure 21:
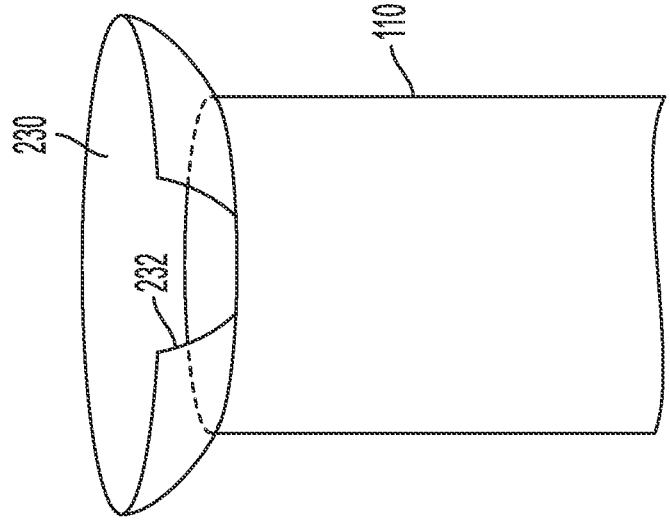
FIG. 21 is a side view of a food container and dispenser including a spill guard or gutter in accordance with further aspects of an embodiment of the invention.

Further, in some configurations and as shown in FIG. 21, a spill guard and/or gutter 230 may be provided, forming a mouth enclosure collar with a wide gutter to keep food bits from spilling out of the mouth of the unit. Such a guard and/or gutter may include an indentation 232 in one portion to allow easy user mouth access to the lip of the container. Further, such a guard and/or gutter may be integrally formed with container body 110, or alternatively may comprise a separate, removable element that may be placed at the top of container body 110 during use.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It should be understood, therefore, that the invention may be practiced otherwise than as specifically set forth herein.

What is claimed is:

1. A hand-held food dispenser configured for one-handed operation, comprising:

a container having one or more manually compressible exterior walls;

a food dispensing outlet at a top end of said one or more manually compressible exterior walls;

a lift inside of said container having at least a first tapered wall and engaging an interior of said container such that manual compression on an outside of said container by one hand of a user causes said lift to move along a length of said container, wherein an outer surface of the lift conforms to the interior of the container;

wherein said food dispensing outlet is sized with respect to said lift so as to allow removal of said lift through said food dispensing outlet; and wherein said interior of said container defines a lift engaging surface that is configured to allow linear, bidirectional movement of said lift within said container.

2. The hand-held food dispenser of claim 1, wherein said lift engaging surface is further configured to hold said lift at a stopping position of the lift along said length of said container upon removal of said manual compression on the outside of said container.

3. The hand-held food dispenser of claim 2, wherein said lift engaging surface is selected from the group consisting of (a) a flexible layer on the interior of said container engaging the outer surface of the lift; (b) at least one gripping member extending radially inward from the interior of said container; and (c) at least one gripping member extending radially outward from an exterior wall of said lift.

4. The hand-held food dispenser of claim 1, said lift further comprising a top edge and a collar wall extending down from said top edge, wherein said first tapered wall and a second tapered wall extend downward from said collar wall.

5. The hand-held food dispenser of claim 4, said container further comprising a base attached to said one or more manually compressible exterior walls of said container, said base having a lift receiver having angled walls that are formed complementary to said first tapered wall and said second tapered wall of said lift.

6. The hand-held food dispenser of claim 1, said container further comprising a base attached to said one or more manually compressible exterior walls of said container, said base having a greater rigidity than said one or more manually compressible exterior walls of said container.

7. The hand-held food dispenser of claim 1, said container comprising multiple layers including at least an interior layer and an exterior layer, wherein said interior layer is of greater flexibility than said exterior layer.

8. The hand-held food dispenser of claim 7, wherein said lift is positioned inside of said container with respect to said interior layer so as to push food in said interior layer toward said food dispensing outlet of said container upon movement of said lift in said container.

9. The hand-held food dispenser of claim 1, said hand-held food dispenser further comprising a flexible bag positioned inside of said container.

10. The hand-held food dispenser of claim 1, said container comprising multiple layers including at least an interior layer and an exterior layer of differing flexibility from said interior layer, wherein said interior layer and said lift are removable from said exterior layer.

11. The hand-held food dispenser of claim 1, said container comprising multiple layers including at least an interior layer and an exterior layer of differing flexibility from said interior layer, wherein at least one layer of said multiple layers further comprises a thermally insulating layer.

12. The hand-held food dispenser of claim 1, wherein said one or more manually compressible exterior walls of said container further comprise regions of varying rigidity.

13. The hand-held food dispenser of claim 12, wherein said lift is positioned inside of said container such that a face of a lower tapered wall of said lift is positioned against a region of said compressible exterior wall having a lower rigidity than one or more other regions of said exterior wall.

14. The hand-held food dispenser of claim 1, said container further comprising structural support members extending vertically along an interior side of said one or more manually compressible exterior walls of said container and configured to support said one or more manually compressible exterior walls against collapse from a vertical position.

15. The hand-held food dispenser of claim 14, wherein said structural support members have an edge facing said interior of said container, wherein said edge defines a profile of varying widths throughout a length of said structural support members.

16. The hand-held food dispenser of claim 15, said lift further comprising notches configured to receive said structural support members therein.

17. The hand-held food dispenser of claim 1, wherein said lift further comprises a hollow container having an open top surface, and a removable layer covering said open top surface.

18. The hand-held food dispenser of claim 1, wherein said lift is composed of an edible food product.

19. The hand-held food dispenser of claim 1, wherein said lift is perforated from a top surface of the lift to a bottom surface of the lift.

20. The hand-held food dispenser of claim 1, said container having an open top end defining a perimeter dimension that is smaller than a perimeter dimension of a widest portion of said lift, and wherein said lift is removable from said container through said open top end.

21. A hand-held food dispenser configured for one-handed operation, comprising:

a container having a manually compressible exterior wall;

a lift inside of said container and engaging an interior of said container such that manual compression on an outside of said container by one hand of a user causes said lift to move along a length of said container; and a flexible bag positioned within said interior of said container;

wherein said lift engages said flexible bag such that movement of said lift within said container moves dispensable food within said flexible bag toward an open top end of said container.

22. A hand-held food dispenser configured for one-handed operation, comprising:

a container having a manually compressible exterior wall and having a bottom end and an open top end;

a food dispensing outlet at said open top end of said manually compressible exterior wall; and a lift inside of said container and engaging an interior of said container such that manual compression on an outside of said container by one hand of a user causes said lift to move along a length of said container;

wherein said open top end of said container has an open top end perimeter that is smaller than a perimeter of said lift; and wherein said food dispensing outlet is sized with respect to said lift so as to allow removal of said lift from said container through said food dispensing outlet.

23. A hand-held food dispenser configured for one-handed operation, comprising:

a container having a manually compressible exterior wall;

a food dispensing outlet at a top end of said manually compressible exterior wall;

a lift inside of said container and engaging an interior of said container such that manual compression on an outside of said container by one hand of a user causes said lift to move along a length of said container; and at least one gripping member on at least one of said container and said lift, wherein said at least one gripping member is positioned to create friction between said lift and said interior of said container that resists movement of said lift inside of said container;

wherein said food dispensing outlet is sized with respect to said lift so as to allow removal of said lift through said food dispensing outlet.

* * * * *